United States Patent [19]

Schmulian

[11] 4,379,428

[45] Apr. 12, 1983

[54] HAMMER LOCATING AND OPERATIONAL MEANS

[75] Inventor: David E. Schmulian, Woodland Hills, Calif.

[73] Assignee: Burroughs Corporation, Detroit, Mich.

[21] Appl. No.: 168,945

[22] Filed: Jul. 11, 1980

[30] Foreign Application Priority Data

Jul. 24, 1979 [GB] United Kingdom ..... 7925811

[51] Int. Cl.[3] ..... B41J 9/12

[52] U.S. Cl. ..... 101/93.09; 101/93.14; 101/93.48

[58] Field of Search ..... 101/93.09, 93.15, 93.16, 101/93.17, 93.14, 93.48; 400/322

[56] References Cited

U.S. PATENT DOCUMENTS

| | | | |
|---|---|---|---|
| 3,672,297 | 6/1972 | Bergland et al. | 101/93.09 |
| 3,673,955 | 7/1972 | Curtiss et al. | 101/93.48 |
| 3,941,051 | 3/1976 | Barrus et al. | 101/93.04 |
| 4,077,336 | 3/1978 | Talvard et al. | 400/124 X |
| 4,213,714 | 7/1980 | Jones et al. | 400/322 X |
| 4,232,975 | 11/1980 | Kane | 400/322 X |
| 4,235,167 | 11/1980 | Staugaard | 101/93.09 |
| 4,248,148 | 2/1981 | Mahoney et al. | 101/93.09 |
| 4,279,523 | 7/1981 | Ringle | 400/322 X |

FOREIGN PATENT DOCUMENTS

| | | | |
|---|---|---|---|
| 2054920 | 2/1981 | United Kingdom | 101/93.09 |

*Primary Examiner*—Edward M. Coven

*Attorney, Agent, or Firm*—D. G. Rasmussen; K. R. Peterson; E. M. Chung

[57] ABSTRACT

An apparatus is provided, for use in an impact printer, in which printer it is required that an impact producing hammer, or assembly of such hammers, be operable in more than one location, whereby the hammer or assembly of hammers is moved between operational positions, the operation of the hammer or assembly of hammers is inhibited except when correctly positioned for operation, any mispositioning of the hammer or assembly of hammers is automatically corrected, wear, introduced by movement of the hammer or assembly of hammers, is minimized, and high operational speed, of the printer, is attained.

11 Claims, 4 Drawing Figures

HAMMER LOCATING AND OPERATIONAL MEANS

FIELD OF THE INVENTION

The present invention relates to an impact printer. More particularly, the present invention relates to an impact printer of the so called 'chain' variety, wherein a type-bearing chain, on which all required characters to be reproduced on paper are carried, circulated endlessly between an ink ribbon, overlying paper, and a plurality of hammers, each hammer bearing onto a site where it is required to print a character, the plurality of hammers being disposed along the line of printing, each hammer being individually operable so as to strike a require type character, as it passes, on the chain, and so create a printed record on the paper.

More particularly, the present invention relates to the transference of an assembly of such a plurality of hammers, known as a hammer bar, quickly and accurately between alternate operational positions within the printer.

In greater particularity, the present invention relates to a method and apparatus for the control of a rotating shaft, driving an eccentric coupling, and so imparting reciprocating, transverse motion to a hammer bar, along the line of printing, and in so doing, moving the hammer bar between alternate operational positions within the printer.

In still greater particularity, the present invention relates to a method and apparatus, for the control of a rotating shaft, driving an eccentric coupling, and so imparting reciprocating transverse motions to a hammer bar, along the line of printing, and, in so doing, moving the hammer bar between alternate operational positions in such a way that mechanical wear is minimised and high overall operational speed of the printer is attained.

THE PRIOR ART

In the design of chain printers, popular as output devices for computer systems, it is usual to provide that a chain, bearing type characters, passes endlessly before an array of hammers. As a character, required to be printed onto paper in a particular location on a line of print, passes before the hammer corresponding to that location, the hammer is individually activated, producing an impact against the type which forces the type against an ink ribbon and the ink ribbon against the paper, so transferring the character as a visual, printed record to the surface of the paper.

The individual hammers are generally activated by individual solenoids. In practice, a plurality of such hammers are mounted, side by side, along a line of print. The assembly of the plurality of hammers is known as a hammer bar. In the ideal case, there would exist one hammer for every character of the line of print. The size of the hammer and solenoid together make it extremely difficult to achieve this, and it is usual to provide an array of hammers covering only every alternate character in the line of print. In order to print the remaining characters, the hammer bar is moved sideways by one character width before again becoming operative.

It is important to the operation of the hammer bar that it be correctly located before it is operated. If the hammer bar is out of its correct position when operational, the printed characters will be struck off center as the appropriate character passes the location where the hammer corresponding to that location on the line of print should be. There is a risk that the position of printed character on the paper will not be in its correct location on the line. Damage to both the type on the chain and the hammer may ensue. In extreme cases, the hammer may miss the character altogether, and either print nothing, or the wrong, adjacent character on the chain.

A solution to the problem of the transverse positioning of the hammer bar has been attempted in the form of a direct solenoid drive, returned by spring force, moving the hammer bar between endstops located so as to halt the hammer bar in its correct operational positions. This method, while proving functionally successful, has the considerable disadvantage of generating enormous amounts of acoustic noise associated with the rapid impact, at around fifty times per second, of the hammer bar against it endstops. In addition, the repeated shock load to the hammer bar causes a considerable life expectancy problem.

A more acceptable approach to the problem exists in the coupling of the hammer bar to a rod, cyclically mobile along the line of print, and driven at one end by an eccentric coupling to a rotating shaft. The rotation of the shaft is positionally controlled. It is arranged that the hammer bar is in a correct position for operation when the cyclic, sinusoidal motion of the rod is at one or other of its extremes. In this way, the hammer bar spends most time around the correct positions for its operation, and is accelerated and decelerated between these positions with a steady, smooth action, avoiding shock loads and so minimizing damage to the hammer bar.

It has been usual to control the rotation of the shaft, driving the eccentric, by means of a closed loop rotational position control servomechanism. Because of the large amount of holding torque required to maintain the hammer bar in its operational position during the administration of impacts, and the large amount of power required to transfer the considerable mass of the hammer bar at high speed, from one location to the other, it has been usual to employ, as the motive member for the shaft, a stepper motor, whose inbuilt precision and low cost, set against the corresponding cost for a similarly precise, high power D.C. motor, prove most attractive. In addition, the inertial load as seen by the shaft, is complicated by the presence of the eccentric drive to the load, as well as by the presence of springs and other energy storage devices attached to the hammer bar. The frequency response of the load, as seen by the shaft, is a changing function with the degree of shaft rotation, cyclic with shaft rotation. This rotational position sensitive variation of the frequency response of the shaft makes it extremely difficult to provide for proper compensation to be applied in a servo control loop for the achievement of optimum performance in a D.C. motor.

It has been the usual practice to employ a polyphase stepper motor as the shaft rotating element. In order to close the control loop around the motor, an optical shaft encoder is coupled to the shaft, and lightsource and photodetector pairs arranged around the shaft encoder, one pair for each phase of the stepper motor, in order to automatically control the switching of the power between phases. The output of the photodetector is indicative of the rotational position of the shaft with respect to phase which is currently energised, and this knowledge is used to provide, as a well known art, the appropriate energisation of the next phase so as to produce optimum performance from the stepper motor in terms of speed of transit and least ringing.

The variability of the load, as seen by the shaft, is a major problem in this area. The servo compensation in the form of advance or delay of the switching of the next phase, required to give best performance from the stepper motor, is a complicated function of the rotational position of the shaft. The associated electronic devices, designed to give correct compensation for the entire rotation of the shaft, are complex and costly. If as is usually the case, the compensation is deliberately kept simple, the performance from the stepper motor is demonstrably very suboptimal.

In addition, the shaft encoder must provide information indicative of the hammer bar being in a correct position for operation, before operation of the individual hammers may correctly take place. This required the presence of further photodetectors. These reasons concerning the precision and complexity required for successful operation of such a system, collectively render even the simplest of such systems costly and complicated, since they require great mechanical precision and electronic complexity for their control.

In the prior art, it has been the practice, in the design of such printers, to provide, as the operational sequence of the printer as a whole, that the hammer bar firstly, prints in its first operational position, secondly, is moved to its second operational position, thirdly, prints at its second operational position, fourthly, is returned to its first operational position, and fifthly, the paper is advanced, on the completion of the line of print, by one vertical line spacing. The cycle of operations is identically repeated for every printed line. The great amount of movement required of the hammer bar results in considerable wear of the hammer bar transport bearings and the motor, bringing attendant life expectancy problems.

It is therefore, desirable to provide a hammer bar positioning system, consistent with the use of a rotational motor possessing the minimum of position sensing members. It is also desirable to provide a systems which is self correcting in the event of the hammer bar being in the wrong location at the time it is required to operate its individual hammers. It is further desirable to provide a hammer bar positioning system whose transit time from location to location is not limited by the complexity or lack or complexity of compensation.

It is still further desirable to provide a method and apparatus for the control for the position of a hammer bar whereby mechanical wear is minimised by the minimization of the number of required movements, and which is gives a high speed to the overall operation of the printer.

In a preferred embodiment of the present invention, there is provided, as an integral part of an impact, chain printer, a hammer bar moving apparatus, the apparatus comprising a three phase stepper motor, a driver assembly, containing one driver for each phase winding of the stepper motor, a shaft, a cutaway disc, a lightsource, a photodetector, an eccentric motion converter, and a controller.

The stepper motor is coupled to, and imparts rotational displacement to, the shaft, which, in turn, is coupled, as the driving input, to the eccentric motion convertor. The eccentric motion convertor changes the rotational displacement of the shaft into linear displacement, and provides, as its output, at 90 degrees to the axis of the shaft, a reciprocating, rectilinear motion, executing one cycle of the motion for each rotation of the shaft, the motion being coupled to the hammer bar, so that it too executes the same rectilinear, reciprocating motion.

The cutaway disc is concentrically and coaxially affixed to the shaft, such that the plane of the disc is at 90 degrees to the axis of the shaft. The lightsource and the photodetector lies along a line parallel to the axis of the shaft. The lightsource provides light for the photodetector. The lightsource lies on one side of the disc, and the photodetector on the other. Half of the periphery of the disc is cut away, providing a 180 degree missing sector, bounded by radial edges. The path of the light, between the lightsource and photodetector, is arranged to pass through the missing sector. When the missing sector lies between the lightsource and the photodetector, light falls onto the photodetector, which when irradiated, provides, as its output, a logically true signal. When with the further rotation of the shaft, and hence, of the disc the missing sector no longer lies between the lightsource and the photodetector, and the material of the disc interposed in the lightpath, no light falls onto the photodetector, which, when not irradiated, provides, as its output, a logically false signal.

The leading and trailing edges of the missing sector of the disc are arranged to respectively expose or cover the lightsource, with respect to the photodetector, at a predetermined angular distance, in terms of the rotation of the shaft, before each of the two operational position of the hammer bar, these being at either extremity of the reciprocating, rectilinear motion.

The controller provides an output, coupled to the driver assembly as an input, comprising three signals, one for each of the phases of the stepper motor, the outputs each activating one driver. The stepper motor is caused to turn the shaft by the energisation of the appropriate, individual phase windings of the stepper motor, in sequence, the sequence and timing of the energisations being dictated by the controller. The motor is, at all times, turned unidirectionally.

The output of the photodetector is coupled, as an input, to the controller. The controller is bidirectionally coupled to the printer. The controller provides two inputs to the printer, a first input indicative being indicative of the hammer bar being free to operate, and a second input indicative of which of the two operational positions the hammer bar occupies. The printer provides two inputs to the controller, a first input being indicative of a request for the hammer bar to be moved to its other operational position, and a second input being indicative of a request for initialization.

The controller is co-operatively interactive with the printer, possessing, within this co-operation, three modes of operation, the 'POWER UP' mode, the 'RECALIBRATE' mode, and the 'NORMAL' mode.

The controller spends most of its time in the 'NORMAL' mode, this being the mode of operation which moves the hammer bar from one operational position to the other. In the 'NORMAL' mode, the controller waits, with the hammer bar at one or other of its operational positions, until the printer signals to it a request for the hammer bar to be moved to its other operational position. In response, the controller issues signals, controlled in timing and sequence, to the driver assembly, causing the motor to turn the shaft, unidirectionally, the turning adhering to a controlled velocity versus rotation profile, and lasting through exactly 180 degrees. In so doing, the controller counts the number of steps it has instructed the stepper motor to execute. On the step before the edge of the missing sector of the disc, is due, should operation be correct, to either expose or cut off the lightsource from the photodetector, the controller examines the logical state of the output of the photodetector. After the completion of that step, the controller again examines the logical state of the output of the photodetector. If the state has changed, the controller continues in the 180 degree velocity controlled movement of the hammer bar, bringing the hammer bar to rest at its other operational position. In so doing, the controller, from a knowledge of whether the output of the photodetector went from true to false or vice versa, issues a signal to the printer, indicative of which of the two operational positions the hammer bar occupies, and, at the time of stopping of the hammer bar, issues a further signal, to the printer, indicating that the hammer bar is free to be operated.

If, during the velocity controlled movement, in 'NORMAL' mode, at the examination, in two places, of the logical state of the output of the photodetector, it is seen that the light does not change, this is taken as being indicative of a slip or other displacement error having occurred during that movement, and the controller passes directly into 'RECALIBRATE' mode. In 'RECALIBRATE' mode, the position of the hammer bar, having been lost, is recovered by the bringing of the hammer bar to a known point. The controller issues slow, unidirectional, signal steps to the stepper motor, examining the output of the photodetector after the completion of each step, until the step is found where the light to the photodetector changes. The position of the hammer bar having been thus re-established, the controller passes back into 'NORMAL' mode.

In 'POWER UP' mode, the controller, at the request of the printer, calibrates the position of the hammer bar, just as for the 'RECALIBRATE' mode. In the 'POWER UP' mode the object is to find the position of the hammer bar prior to first operation. The difference between the 'POWER UP'and the 'RECALIBRATE' modes is that the printer initiates 'POWER UP', while the controller initiates 'RECALIBRATE'.

The printer, in its overall operational procedure, only requests that the controller move the hammer bar to the alternate operational position on every alternate hammer activation. The printer thus activates the hammer bar at the first operational position, moves the paper vertically, activates the hammer bar again at the first operational position, moves the hammer bar to the second operational position, activates the hammer bar at the second operational position, moves the paper vertically, operates the hammer bar at the second operational position for a second time, and returns the hammer bar to the first operational position. In this way, the hammer bar prints at the first location and then at the second location on every odd line of print, and prints at the second location and then at the first location at every even line of print, or vice versa, so reducing the number of required movements of the hammer bar by a factor of two over that required in the prior art, and omitting the return of the hammer to its starting point during the vertical movement of the paper.

The operation of the preferred embodiment of the present invention, together with further aims and objectives thereof, will be better understood from the following description taken in conjunction with the accompanying drawings.

DESCRIPTION OF THE PREFERRED EMBODIMENT

Figure 1:
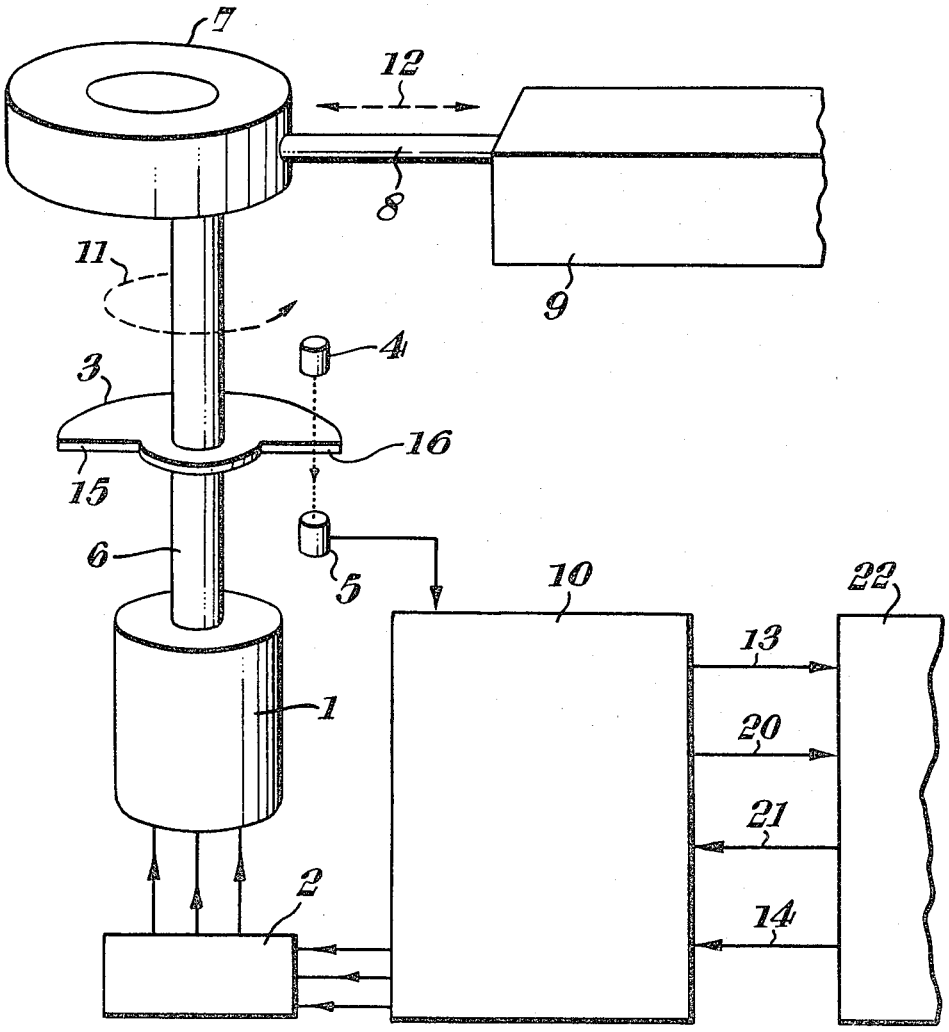
FIG. 1 shows, in schematic form, the system of the preferred embodiment of the present invention.

Attention is first drawn to FIG. 1 showing, in schematic form, the system of the preferred embodiment of the present invention.

A three phase stepper motor (1) is energised via three drive circuits (2). Each of the individual drive circuits (2) is selectably and separately operable responsively to signals from a controller (10). The stepper motor (2) possesses a plurality of equilibrium positions with the energisation of each of its phases. These positions are cyclically repetetive with the rotation of the motor (2), so that a 'phase one' position will always be adjacent, counter clockwise to a 'phase three' position, and adjacent, clockwise, to a 'phase two' position. By energising a phase clockwise adjacent to that last energised, the motor may be caused to rotate clockwise, and vice versa. The stepper motor (1) rotates in a unidirectional manner, a shaft (6) which has, concentrically and axially affixed to it, a disc (3). The shaft (6) is coupled, as the driving input, to an eccentric motion converter (7). A rod (12), coupled as the output of the eccentric motion converter (7), transmits the reciprocating, transverse, rectilinear motion, which it experiences, as the shaft (6) rotates, to a hammer bar (9).

The disc (3) has a missing sector. The missing sector possesses a trailing edge (16) and a leading edge (15). A light source (4) provides light incident on a photodetector (5). The disc (3) in interposed between the light source (4) and the photodetector (5). As the disc (3) rotates, the missing sector of the disc (3) allows light to fall onto the photodetector (5), but the solid part of the disc (3) prevents light from reaching the photodetector (5).

The photodetector (5) provides, as its output, a logic signal which is true if light is incident upon it, and otherwise false. The output of the photodetector (5) is coupled, as an input, to the controller (10).

The controller (10) is co-operative with the printer operating system (22), which is attendant upon the normal operation of the printer. Within this co-operation, the printer operating system (22) provides two outputs to the controller (10), a first input, on the coupling indicated as 21, indicative of the 'POWER UP' condition, where operation of the controller (10) is required for the first time, and a second input, on the coupling indicated as 14, indicative of a request, from the printer operating system (22), for the controller (10) to move the hammer bar (9) from one operational position to the other, this last signal hereafter being known as the 'OP' signal.

In its turn, the controller (10) provides two outputs, coupled as inputs to the printer operating system (22), a first output, on the coupling indicated 13, indicative, by its logical truth or falseness, of which of the two operational positions the hammer bar (9) currently occupies, and a second output on the coupling marked 20, enabling the operation of the individual hammers on the hammer bar (9), and indicative of a successful transit, of the hammer bar (9), from one operational position to the other.

Figure 2:
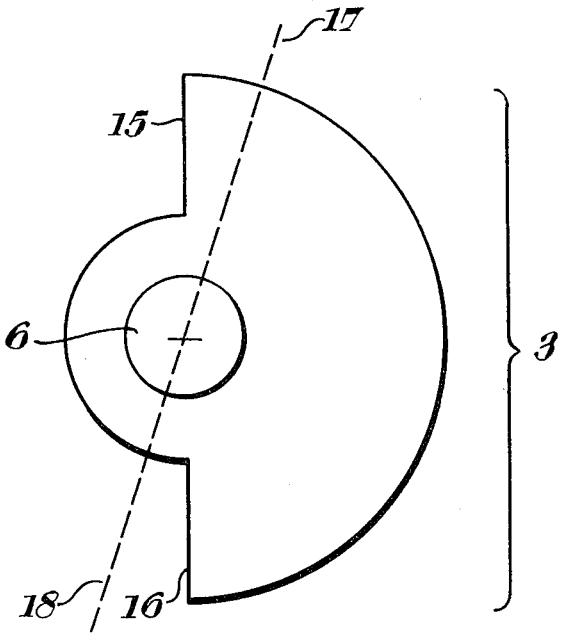
FIG. 2 shows, in detail, the light-interactive disc affixed to the controlled rotation shaft, as well as indicating the point of operation of the hammer bar.

Attention is next drawn to FIG. 2, showing details of the disc (2) and its relationship, on the shaft (6), to the operational positions of the hammer bar (9). 180 degrees of the outer edge of the disc (3) is removed, forming a missing sector. The leading edge (15), of the missing sector, having just passed the lightbeam, and so having allowed light to fall on the photodetector (5), is indicative of the first correct position for operation of the hammer bar (9) being three steps of the stepper motor (2) further on. This position is indicated by the first dotted, radial line (17). The trailing edge (16) of the missing sector, having just cut off the light to the photodetector (5), is indicative of the second correct position for operation of the hammer bar (5) being three steps further on. This other correct position is indicated by the second radial dotted line (18).

Figure 3:
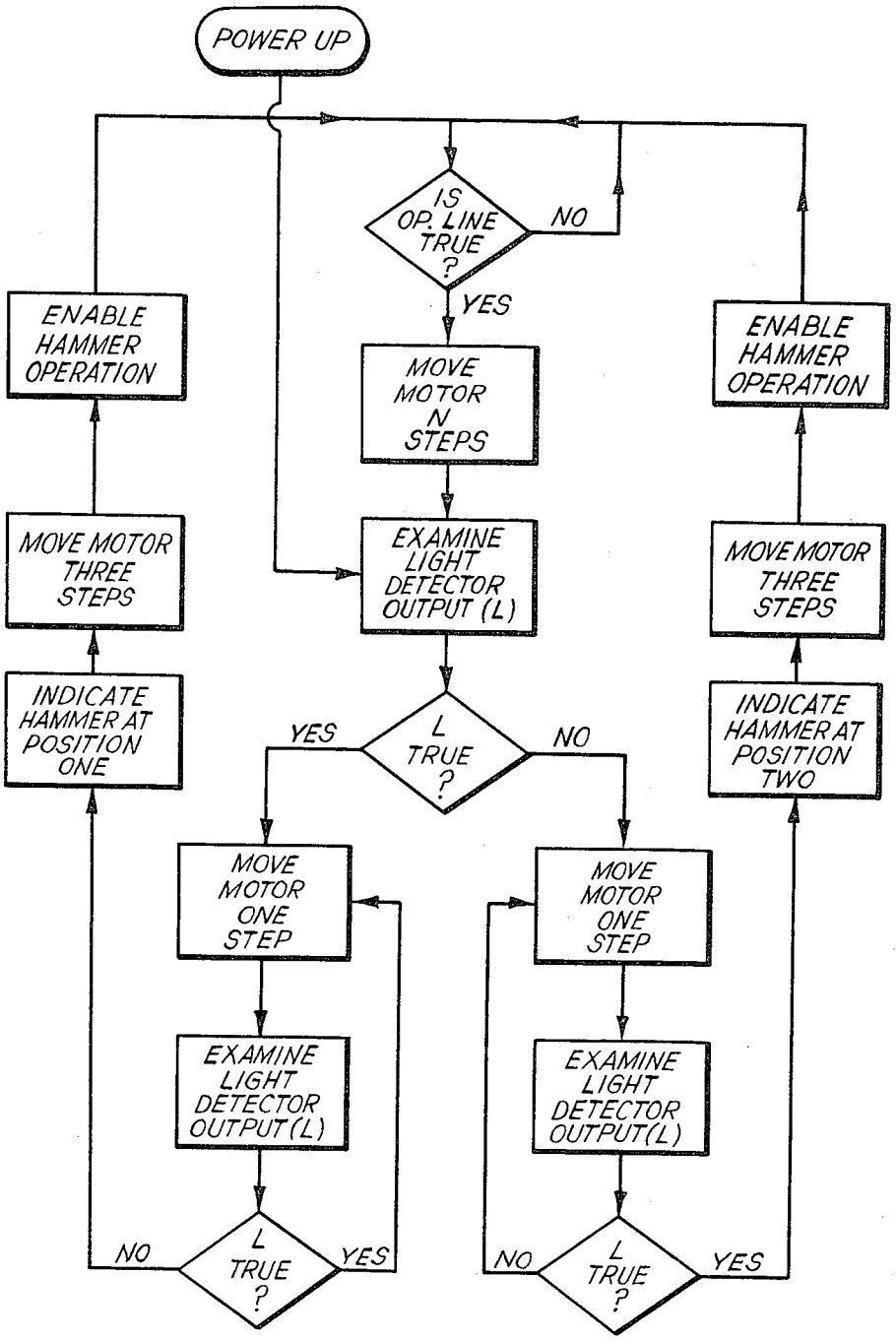
FIG. 3 shows, by way of a flow chart, the operational proceedure of the controller in the preferred embodiment of the present invention.

Attention is next drawn to FIG. 3, which shows, by way of a flow chart, the operational procedures of the controller (10) as it interacts with the printer operating system (22), the motor (2) and the photodetector (5). Whenever the printer has first need to employ the hammer bar moving apparatus, the printer operating system (22) sends a logical true level, briefly, onto the connector 21, indicating to the controller (10) that the 'POWER UP' sequence should begin. This sequence initializes the position for the hammer bar (9) prior to operation of the printer. On receipt of the 'POWER UP' command from the printer operating system (22), the controller (10), by sequentially energising the phases of the stepper motor (2), in a unidirectional, slow, steady fashion, increments the rotational position of the shaft (6) in a similarly slow fashion. The controller (10) examines, after each step of the motor (2) has been allowed time for completion, the logic state of the output of the photo detector (5). When the step is found on which the output of the photo dector (5) changes, it is known that the shaft (6) is three rotational steps away from the hammer bars (9) operational positions the hammer bar (9) is about to occupy from the direction of the change of the output of the photodector (5). If the output passes from logical true to logical false, the operational position is designated as being the first position. If the output passes from logical false to logical true then the position is designated as being the second position. It is important, for the operation of the printer operating system (22), that it should know where the hammer bar (9) is, so that it will know for which of the two alternate sets of characters it should energise the individual hammers, on the hammer bar (9). This information is therefore relayed from the controller (10) to the printer operating system (22) by the controller (10) which drives the connector 13, a logically true signal thereon being indicative of the hammer being in the first position, and a logically false signal thereon being indicative of the hammer bar (9) being in the second position. After completion of the 'POWER UP' sequence, the controller (10) passes into normal operation.

In normal operation, the printer operating system (22) is required to do such things as increment the vertical position of the paper, complete the strobing of the individual hammers on the hammer bar (9), and assemble data, before the hammer bar (9) is required to take up its new position. The hammer bar (9) must therefore stay in its last operational position until instructed to move by the printer operating system (22). The controller (10) therefore waits, with the hammer bar (9) in its last operational position, until the 'OP' line, driven by the printer operating system (22) on the connector 14, becomes logically true. When this occurs, the controller (10) administers, as part of velocity profiled sweep of the hammer bar (9) from one position to the other, a number of steps, to the stepper motor (2), equal to four steps less than the number required to rotate the shaft by 180 degrees. By counting the administered steps, and so having allowed for their completion, the controller (10) brings the shaft (6) to the point where the controller (10) examines the logical state of the output of the photodetector (5). The controller (10) then administers another step to the stepper motor (2). At the end of this step, the controller again examines the logical condition of the output of the photodetector (5). If the logical state of the output of the photodetector (5) has not changed, from the result of the last examination, the controller (10) goes into recalibration mode. If the logical state has changed, this is indicative of the transit from one operational position to the other of the hammer bar (9) having been successfully completed without slip or other problems. The controller (10) signals to the printer operating system (22), as described above, which of the two operational positions the hammer bar (9) currently occupies. The controller (10) then administers three further steps to the stepper motor (2), so bringing the hammer bar (9) to its correct position for operation, and sends a signal, to the printer operating system (22), on the connector 20, indicative of the hammer bar (9) being so positioned, this signal being employed, by the printer operating system (22), as an enabling signal for the operation of the individual hammers in the hammer bar (9). The transit of the hammer bar (9), being complete, the controller (10) takes no further action, but returns to its starting condition of waiting for the 'OP' line to again go logically true, signalling the start of another requested transit.

In its recalibration condition, which is entered into as a result of an unsuccessful transit of the hammer bar (9) from its last operational position, the controller (10) causes the shaft (6) to rotate until the hammer bar is once again 'found'. The controller (10) administers slow, single steps to the stepper motor (2), allowing time for the completion of each step, and examines the logical condition of the output of the photodetector (5) after every step. This behaviour continues until such time as the step is found where the logical condition of the output of the photodetector (5) changes. The position of the shaft (6), and therefore of the hammer bar (9), is then known. In the same manner as for the 'POWER UP' sequence, the controller (10) then returns to its normal operation.

Figure 4:
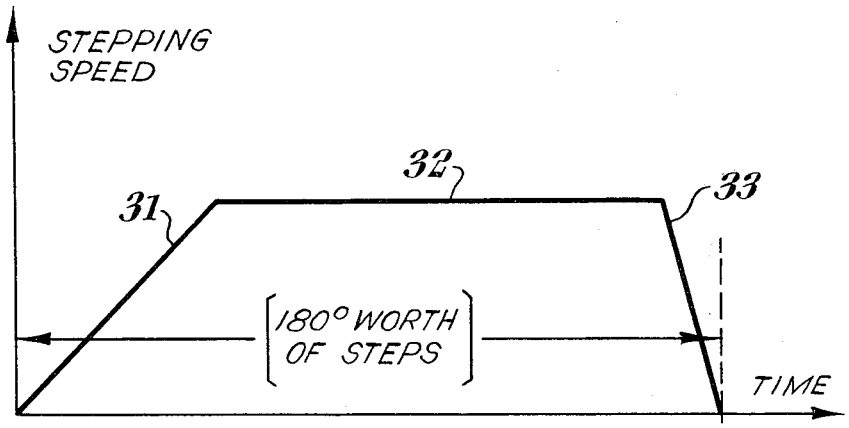
FIG. 4 shows, by way of a graph, the speed versus time profile adopted, in the preferred embodiment of the present invention, in order to ensure rapid transit of the hammer bar from one operating position to the other.

In causing the hammer bar (9) to move expeditiously from one operational position to the other, the controller (10), by varying the time between the changing of energisation from one phase to another, of the stepper motor (2), achieves the rotational stepping speed versus time profile shown in FIG. 4. It is to be understood that during normal operation, as the hammer bar (9) moves from one to the other operational position, there is no deviation from this profile right up to the enabling of the hammer bar (9) as indicated in FIG. 3. The examination of the photo detector (5) output occurs between steps, the step timing adhering to the graph of FIG. 4.

From the stopped condition, the step rate is steadily increased up an initial ramp (31), until a cruising speed (32), consistent with the avoidance of the well known resonance conditions in stepper motors, is reached. The controller (10) knows how long to hold a particular phase energisation of the stepper motor (2) by counting the number of steps it has administered, and referring to a lookup table wherein is stored the timing appropriate to the next step. By establishing and executing the waiting time before the energisation of the next phase, the controller (10) forces the shaft (6) to adhere to the predetermined speed profile. The majority of the transit of the hammer bar (9) is accomplished at the cruising speed (32). After a predetermined number of steps, the stepping rate is reduced, in a rapid manner, mechanically assisted by friction, and other effects, down a sharp terminal ramp (33), until the hammer bar (9) comes to a halt in the next operational position.

The printer operating system (22) issues a request to the controller (10) to move the hammer bar (9) to the alternate position after every second activation of the hammers in the hammer bar (9) at one position. Between each activation of the hammers, the printer operating system attends to the vertical shifting of the paper after the completion of a line of print. The exact sequence of operation is:

1. PRINT AT FIRST POSITION
2. MOVE PAPER VERTICALLY
3. PRINT AT FIRST POSITION
4. MOVE HAMMER BAR TO SECOND POSITION
5. PRINT AT SECOND POSITION
6. MOVE PAPER VERTICALLY
7. PRINT AT SECOND POSITION
8. MOVE HAMMER BAR TO FIRST POSITION

This contrasts with the prior art sequence:

1. PRINT IN FIRST POSITION
2. MOVE HAMMER BAR TO SECOND POSITION
3. PRINT IN SECOND POSITION
4. MOVE HAMMER BAR BACK TO FIRST POSITION
5. MOVE PAPER VERTICALLY

The printer operating system thus saves half of the number of movements required by the prior art method, and also saves the time required to return the hammer bar (9) during a vertical movement of the paper.

It will be apparant to those, skilled in the art, that a stepper motor with more than three phases may be employed.

It will also be apparant that the hammer bar (9) may be stopped in more than two locations, in which case the number and disposition of missing sectors on the disc (3) must correspond to the positions of the hammer bar (9) for operation.

It will also be apparent that the particular control routine, shown in FIG. 3, may possess many variants within the spirit of the present invention.

It will also be apparant that the velocity against time profile, shown in FIG. 4, may be variously configured within the spirit of the present invention.

It will also be apparent that the correct position of operation of the hammer bar (9) may be any required number of steps beyond the point where the light generated signal changes.

It will also be apparent that the stepper motor (2) may be replaced by any controllable rotating motive source.

It will also be apparant that the light source (4) and photodetector (5) pair may be replaced by any position sensing transducer.

It will also be apparent that the eccentric motion convertor may be replaced by any other form of motion convertor, or, indeed, omitted entirely.

It will also be apparant that the hammer bar (9) may be replaced by any other mechanical load which is required to be placed in more than one location.

I claim:

1. A chain impact printer comprising:

an array of hammers, each hammer being positionable at a plurality of hammer operating positions along a line of printing, said array of hammers being movable;

a stepping motor operable to position said array of hammers along said line of printing, said stepping motor having a plurality of step positions between each adjacent pairs of hammer operating positions along said line of printing;

a position transducer cooperating with said stepping motor to indicate when said array is a first predetermined number of steps away from one of said plurality of operating positions; and, a controller executing a movement sequence to move said array from a first operating position to the next adjacent operating position, said movement sequence including commanding said stepping motor to perform said first predetermined number of steps, said controller receiving the output of said position transducer at the end of said first predetermined number of steps to indicate a first state if said hammer array is in the correct stepping position to subsequently arrive correctly at the next operating position, and a second state if the hammer array is not in its correct stepping position to arrive correctly at the next operating position, said controller responding to said position transducer output being a first state by commanding said stepping motor to move a second predetermined number of steps to bring said array to said next adjacent operating position, and responding to said second state to command said motor to perform a position correction sequence by commanding said stepping motor to perform individual steps and monitoring said output of said transducer for each of said individual steps until a step is found at which said transducer provides a first state indication that said hammer array is in the correct stepping position.

2. A printer according to claim 1 in which said first or second state is determined at the end of said first predetermined number of steps by examining the output of the position transducer on the next to the last step and again on the last step, a change in the position transducer output for the two steps indicates said first state and no change indicates said second state.

3. A printer according to claim 2 wherein said position transducer is a rotary transducer coupled to rotate with said stepping motor.

4. A printer according to claim 3 wherein said transducer is an optical transducer.

5. A printer according to claim 4 wherein said plurality of operating positions consists in two operating positions, wherein said transducer comprises a semicircular opaque disc for breaking a light beam when said array is the next to the last step of said first predetermined number of steps away from the first of said two operating positions and for ceasing to interrupt said light beam when said array is said first predetermined number of steps away from said two operating positions.

6. A printer according to claim 5 wherein said stepping motor is operable to rotate a cam coupled to impart reciprocating rectilinear displacement to said array of hammers, said cam coupled to rotate with said optical transducers, said cam being an eccentric circular cam.

7. A printer according to claim 6 wherein said controller is operable to provide output indicative of said array being at one of other of said two operating positions subsequently to having commanded said motor to perform said second predetermined number of steps.

8. A printer according to claim 5 wherein said controller is operable to provide an output indicative of said array being in said first operating position dependent upon said semicircular disc breaking said light beam on said last one of said first predetermined number of steps and is operable to provide an output indicative of said array being in said second operating position dependent upon said semicircular disc ceasing to interrupt said light beam on said last one of said first predetermined number of steps.

9. A printer according to claim 5 wherein said controller is operable to commence said movement sequence in response to an externally provided command signal.

10. A printer according to claim 1 wherein said movement sequence includes the timing of the provision of said commands to said motor to perform steps such that said motor undergoes a smooth acceleration, executes thereafter a period of constant velocity, and undergoes a smooth deceleration.

11. A printer according to claim 10 wherein said controller commands said motor to perform said steps unidirectionally.

* * * * *